United States Patent [19]

Glejf

[11] 4,381,578

[45] May 3, 1983

[54] CURTAIN ROD HAVING TENSION MOUNTING MECHANISM

[75] Inventor: Robert G. Glejf, Des Plaines, Ill.

[73] Assignee: United States Gypsum Company, Chicago, Ill.

[21] Appl. No.: 250,504

[22] Filed: Apr. 2, 1981

[51] Int. Cl.[3] ..... A47H 1/022

[52] U.S. Cl. ..... 16/94 D; 248/264; 403/374; 403/409

[58] Field of Search ..... 16/94 R, 94 D, 95 D, 16/96 R, 96 D; 211/105.1, 105.3, 105.4; 248/264, 268; 403/374, 409

[56] References Cited

U.S. PATENT DOCUMENTS

| | | | |
|---|---|---|---|
| 420,486 | 2/1890 | Wyant . | |
| 1,037,091 | 2/1912 | Wedge | 403/374 X |
| 1,752,472 | 4/1930 | Whitney . | |
| 2,050,507 | 4/1936 | Stracka | 248/265 |
| 2,974,806 | 3/1961 | Seewack . | |
| 3,764,177 | 10/1973 | Woodward . | |
| 3,795,380 | 3/1974 | Turner | 16/94 D X |
| 3,951,269 | 4/1976 | Anderson | 211/105.4 |
| 3,975,106 | 8/1976 | Steele | 403/374 |

FOREIGN PATENT DOCUMENTS

| | | | |
|---|---|---|---|
| 935409 | 4/1963 | United Kingdom | 16/96 D |

*Primary Examiner*—Howard N. Goldberg
*Assistant Examiner*—Fred A. Silverberg
*Attorney, Agent, or Firm*—Samuel Kurlandsky; Robert M. Didrick; Robert H. Robinson

[57] ABSTRACT

A flexible door or curtain support comprising an elongate member having a track for supporting the door or curtain, and apparatus for providing tension between the elongate member and a supporting wall comprising a pad or wall member for engaging the wall, a pressure plate engaging the end of the elongate member, and wedge or a cam mechanism cooperating with the pressure plate and the pad or wall member, and a mechanism for moving the wedge member to provide longitudinal tension between the elongate member and the wall.

8 Claims, 18 Drawing Figures

CURTAIN ROD HAVING TENSION MOUNTING MECHANISM

BACKGROUND OF THE INVENTION

1. Field of the Invention

The present invention relates to a supporting rod assembly for use in supporting a bathtub, shower or window curtain, and more particularly refers to an assembly that is self-mounting and can be securely affixed between two walls without external fasteners or brackets.

2. Description of the Prior Art

Curtain supports for bathtub or shower enclosures or window curtains or drapes are known in the art. They are generally affixed at their ends to the walls at each end of the enclosure. It is conventional to mount brackets on the walls in order to engage and support the ends of the curtain rod or support. However this requires extensive installation which can become quite costly. Curtain rod assemblies have been disclosed utilizing screw-type end fittings so that the curtain rods may be installed without the need for affixing brackets to the walls. However, such structures have not always been successful and are sometimes difficult to install.

SUMMARY OF THE INVENTION

It is accordingly an object of the invention to provide a curtain support for a shower or bathtub enclosure or window, which is easy to install.

It is a further object to provide a curtain support of the type described which may be quickly affixed and which remains securely in place.

It is still an additional object to provide a curtain support which is relatively inexpensive and for which the parts may be readily manufactured.

Other objects and advantages of the invention will become apparent upon reference to the drawings and details of the description.

According to the invention, a tension or support assembly for a flexible curtain for a bathtub or shower enclosure or a window curtain or drape is provided comprising an elongate member having means for supporting a flexible door or curtain, and longitudinal tension providing means comprising a member for engaging one of the walls, a member for engaging the end of the supporting member, wedge or cam means, and means for moving the wedge means transversely, thereby extending the mounting means until it firmly engages the wall.

DESCRIPTION OF THE PREFERRED EMBODIMENTS

Figure 1:
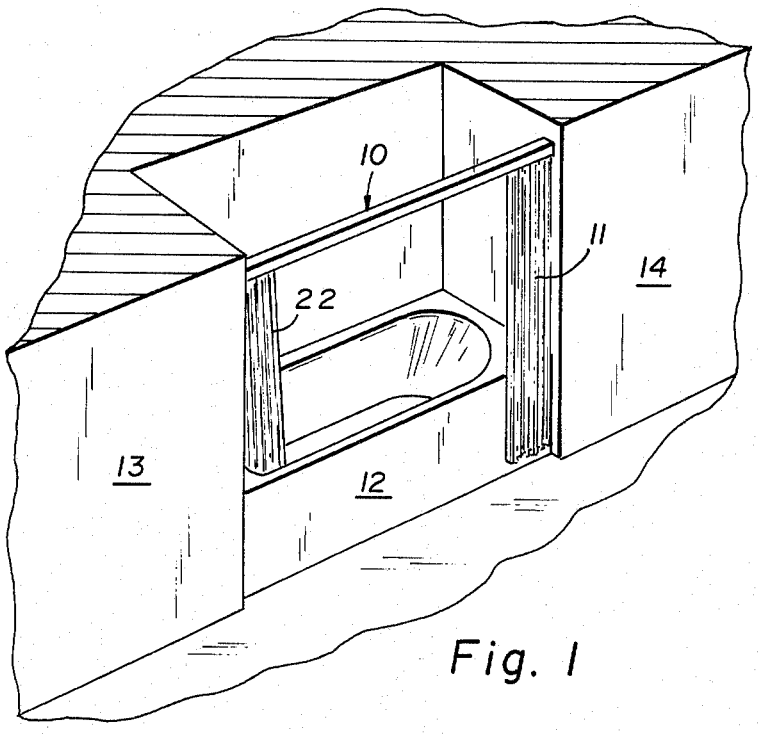
FIG. 1 is a perspective view of a bathtub and enclosure having a curtain supporting mechanism according to the invention.

Referring to FIG. 1, a curtain support 10 having curtains 11 and 22 and mounted thereon is shown mounted over a bathtub 12 positioned between walls 13 and 14.

Figure 2:
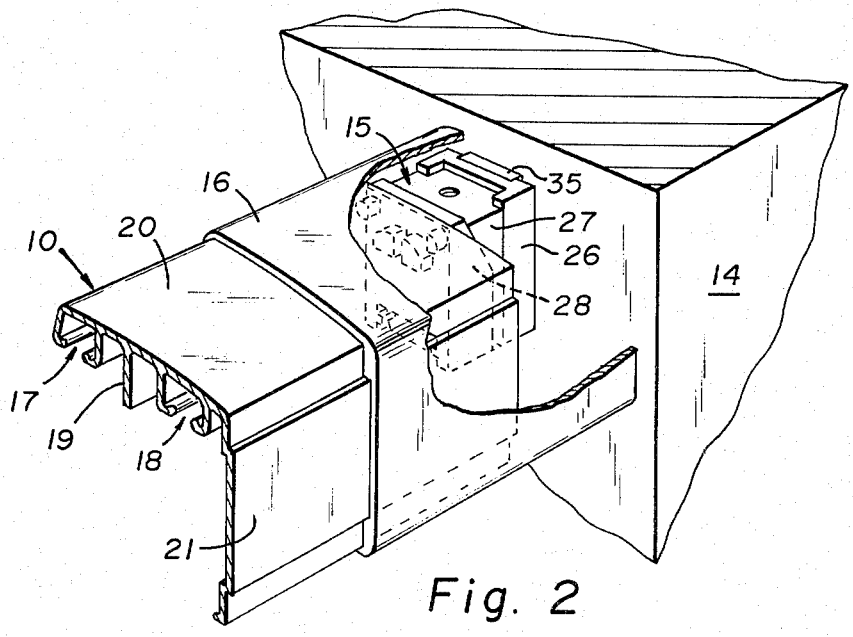
FIG. 2 is a fragmentary perspective view of the end of a curtain rod and broken away to show a portion of the tension mounting structure.

Referring to FIG. 2, one end of the curtain rod 10 is shown mounted against the walls 13 and 14 by means of a tension assembly 15 according to the invention which may be utilized at one or both ends of the curtain rod. An end cap 16 is shown covering the end of the rod and the tension assembly 15. The rod comprises tracks 17 and 18 for supporting curtain hooks and further comprises a central spine 19. The curtain rod has an upper wall 20, and a front decoration wall 21.

Figure 3:
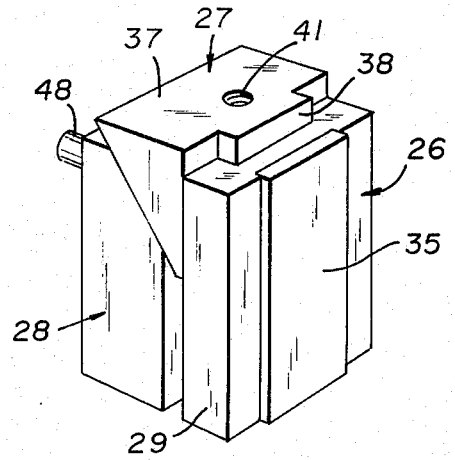
FIG. 3 is a perspective view of the mounting and tension apparatus.
Figure 4:
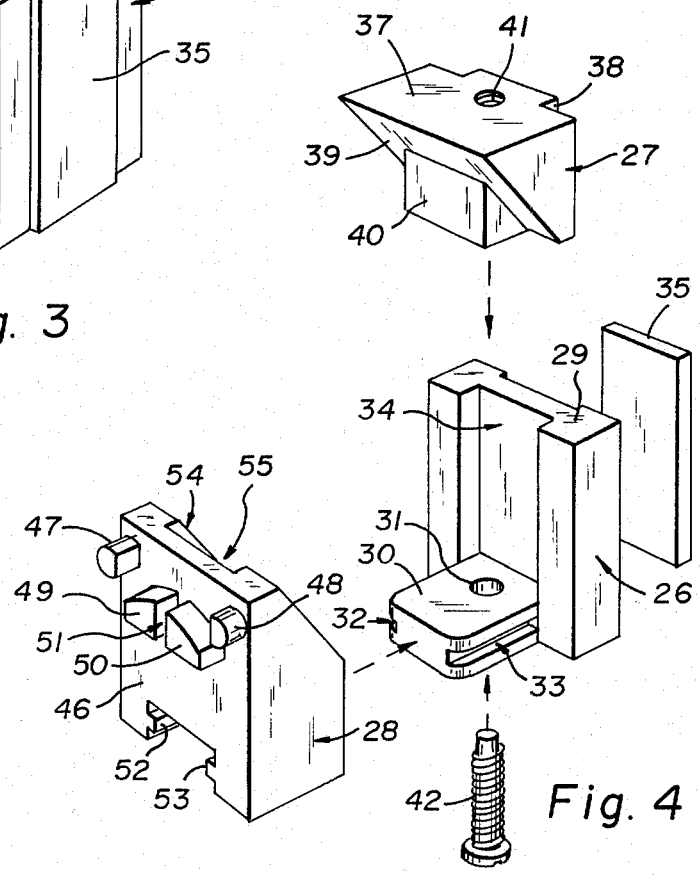
FIG. 4 is an exploded perspective view of the structure shown in FIG. 3.

Referring to FIGS. 3 and 4, a tension assembly 15 is shown. The tension assembly 15 comprises a wall mounting plate 26, a cam or wedge member 27 and a pressure or tension plate 28. The wall mounting plate 26 comprises a body 29 having an integral longitudinal flange 30. The flange 30 is provided with an aperture 31 and longitudinal channels 32 and 33. A guide channel 34 is provided in the body of the wall mounting plate 26 oriented transversely with respect to the longitudinal channels 32 and 33. A pad or piece of tape 35 may be affixed to the wall mounting plate to prevent scratching or marring of the wall 14.

The cam member 27 comprises a cam member body 37 having a gib or guide member 38 adapted to slide in the transverse channel 34. The cam member 27 is provided with an oblique cam surface 39 and a cam surface gib or guide 40. A threaded hole 41 is provided for receiving a screw 42 which extends through the aperture 31.

Figure 5:
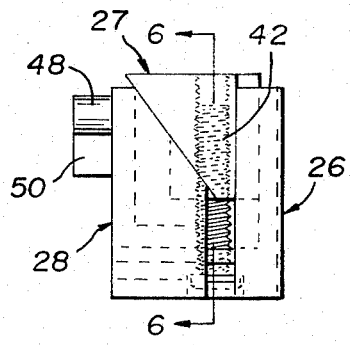
FIG. 5 is a side end view of the structure shown in FIGS. 3 and 4.
Figure 6:
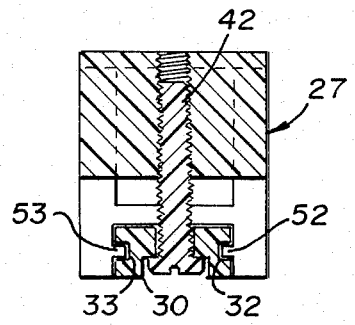
FIG. 6 is a cross-sectional view taken at the line 6—6 of FIG. 5, looking in the direction of the arrows.

The pressure or tension plate 28 comprises a pressure plate body 46 having lugs 47 and 48 and lugs 49 and 50. The lugs 49 and 50 define a slot 51 therebetween to receive the spine 19 of the curtain rod 10. Rails 52 and 53 are provided to engage slidably in the longitudinal channels 32 and 33 respectively. The assembled tension assembly 15 is shown in FIGS. 5 and 6.

Figure 7:
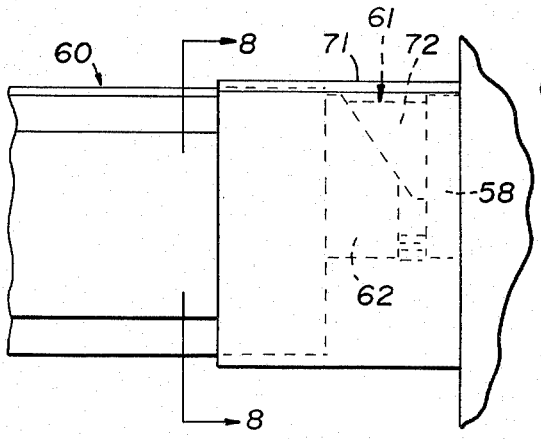
FIG. 7 is a front elevational view of an end of the curtain rod engaged by a mounting assembly according to the invention.
Figure 8:
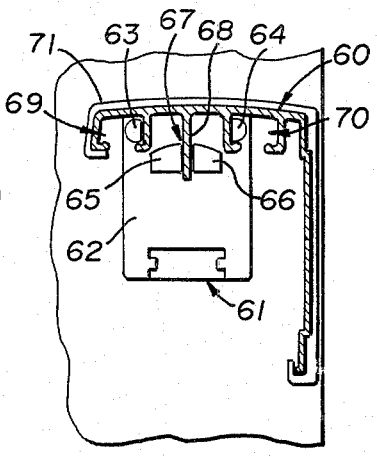
FIG. 8 is a cross-sectional view taken at the line 8—8 of FIG. 7, looking in the direction of the arrows.

Referring to FIGS. 7 and 8, a combination according to another embodiment of the invention is shown, comprising a curtain rod 60, and a tension assembly 61. The assembly is shown in cross-section in FIG. 8 and comprises the end of a pressure plate 62 having lugs 63 and 64, and lugs 65 and 66 defining a slot 67 therebetween. A spine 68 is engaged in the slot 67. The curtain rod has tracks 69 and 70 and an end cap 71. The tension assembly 61 additionally comprises a cam member 72 and a wall mounting plate 58.

Figure 9:
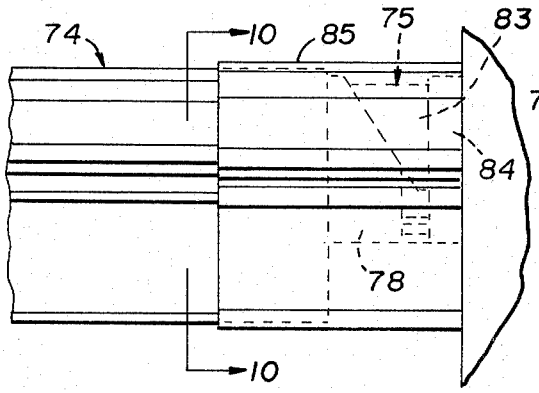
FIG. 9 is a front elevational view of one end of a curtain rod engaged by a mounting apparatus according to the invention, in a modified embodiment.
Figure 10:
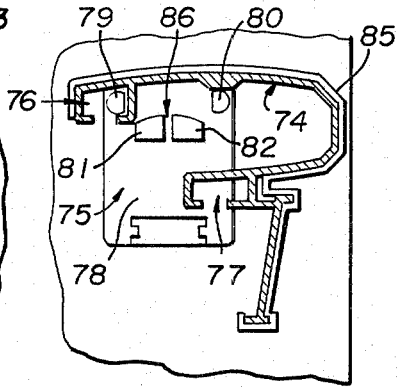
FIG. 10 is a cross-sectional view taken at the line 10—10 of FIG. 9, looking in the direction of the arrows.

Referring to FIGS. 9 and 10, a curtain rod assembly in a somewhat different embodiment is shown comprising a curtain rod 74, and a tension assembly 75. The curtain rod 74 is provided with tracks 76 and 77. The tension assembly comprises a pressure plate 78 having lugs 79 and 80, and lugs 81 and 82 defining a slot 86 therebetween. An end cap 85 covers the end assembly. The tension assembly 75 also includes a cam member 83 and a wall mounting plate 84.

Figure 11:
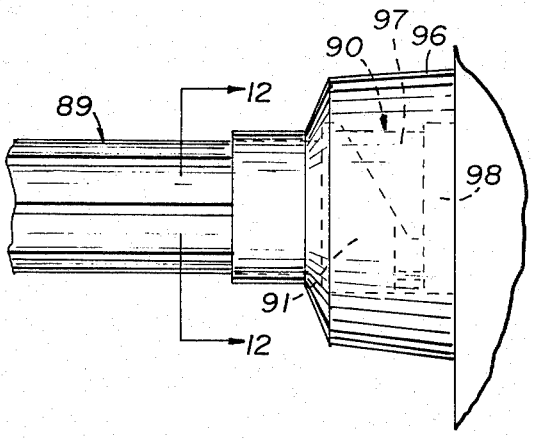
FIG. 11 is a front elevational view of one end of a curtain rod in still another embodiment engaged by a mounting apparatus according to the invention.
Figure 12:
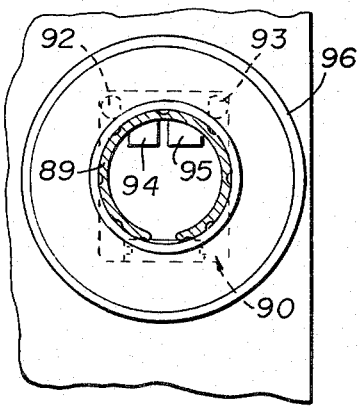
FIG. 12 is a cross-sectional view taken at the line 12—12 of the FIG. 11, looking in the direction of the arrows.

FIGS. 11 and 12 illustrate still another embodiment of the invention comprising a round curtain rod 89, and a tension assembly 90. A pressure plate 91 is illustrated in FIG. 12 having lugs 92 and 93 and lugs 94 and 95. An end cap 96 covers the end structure. The tension assembly also includes a cam member 97 and a wall mounting plate 98.

Figure 13:
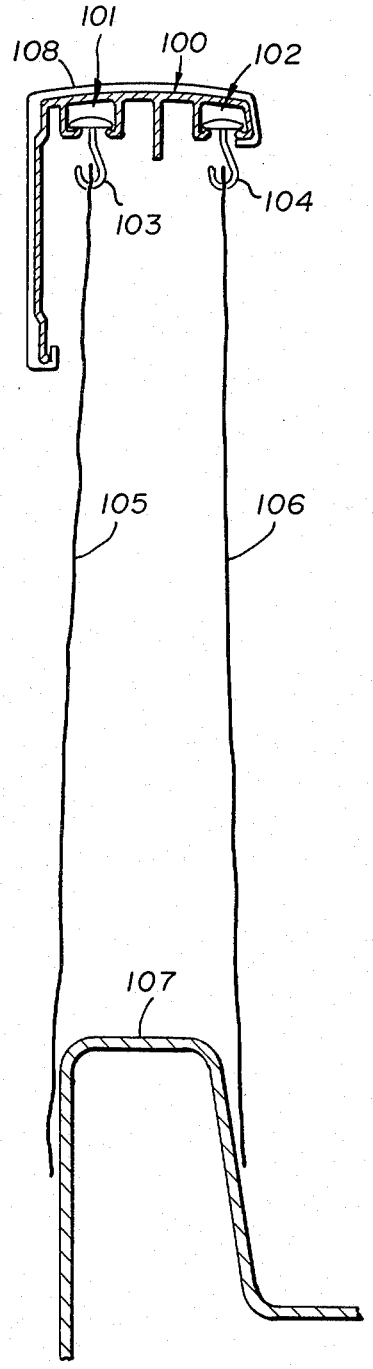
FIG. 13 is a sketch showing an end view of the curtain rod and suspended curtains.
Figure 14:
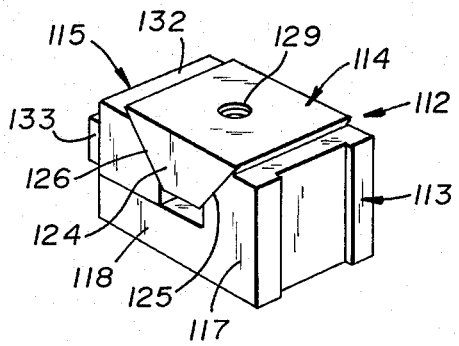
FIG. 14 is a perspective view of a tension assembly in another embodiment of the invention.
Figure 15:
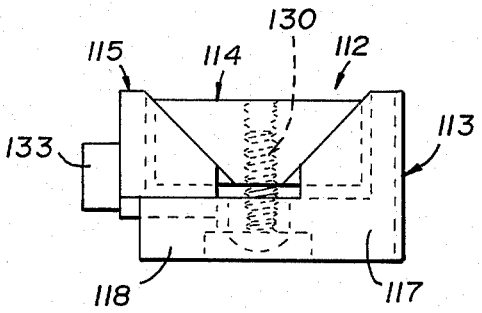
FIG. 15 is a side elevational view, partly in cross-section, of the structure shown in FIG. 14.
Figure 16:
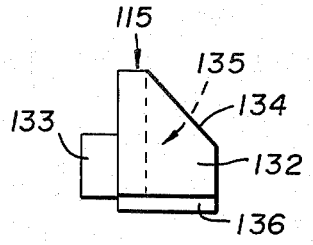
FIG. 16 is a side elevational view of the pressure plate of the structure shown in FIGS. 14 and 15.
Figure 17:
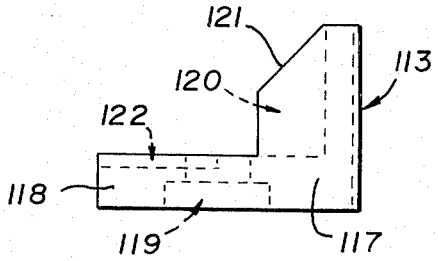
FIG. 17 is a side elevational view of the wall mounting plate shown in FIGS. 14 and 15.
Figure 18:
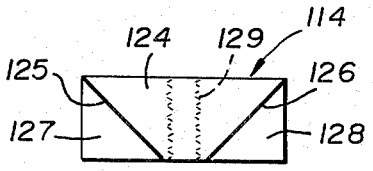
FIG. 18 is a side elevational view partly in cross-section, of the cam member shown in FIGS. 14 and 15.

FIG. 13 is a sketch showing a curtain rod 100 having tracks 101 and 102. Hooks 103 and 104 have enlarged heads which are slidably positioned within the tracks 101 and 102 and support an outer curtain 105 and an inner curtain 106 over a bathtub 107. An end cap 108 is placed over the curtain rod 100.

Referring to FIGS. 14, 15, 16, 17 and 18, another embodiment of the invention is shown comprising a tension assembly 112 similar to that shown in the previous drawings, but having a cam member with two sets of cam surfaces. This structure provides twice the extension range as that shown in the previous drawings. The tension assembly 112 comprises a wall mounting plate 113, a cam member 114 and a pressure plate 115. The wall mounting plate comprises a body 117 having a longitudinal flange 118 integral with a lower portion thereof, and having an elongated aperture 119 provided in the bottom thereof. A transverse channel 120 is provided with oblique cam surfaces 121 on each side of the channel. A guiding channel 122 is also provided in the longitudinal flange 118.

The cam member 114 comprises a body 124 having cam surfaces 125 and 126 and guide members 127 and 128 at the ends thereof. A threaded hole 129 is provided in the body 124 for receiving an adjusting screw 130, which extends through the aperture 119 and engages the threads of the hole 129.

The pressure plate 115 comprises a body 132 having a lug 133 for engaging the end of the curtain rod. Oblique cam surfaces 134 are provided on either side of a transverse channel 135. A guide member 136 is provided for riding in the channel 122 to guide the pressure plate as it moves with respect to the longitudinal flange 118.

At one end of the cam member 114 the oblique cam surfaces 125 engage the cam surfaces 121 of the pressure plate 115, and at the other end of the cam member 114 the cam surfaces 126 engage the cam surfaces 134 of the pressure plate 115. The guide member 127 of the cam member 114 rides in the transverse channel 120 of the wall mounting plate and the guide member 128 rides in the transverse channel 135 of the pressure plate 115.

In operation, the ends of the curtain rod are engaged with the lugs of the pressure plates. If desired a piece of tape or a frictional pad 35 may be placed over the end of the wall mounting plate so that it does not mar the wall. The curtain rod and tension assembly or assemblies are then placed in position between the walls of the tub or shower enclosure. The adjusting screw 42 or 130 is then tightened, drawing in the cam member 27 or 114. The action of the cam surfaces causes the pressure plate 28 or 115 to bear against the curtain rod, forcing it against the opposite wall or opposite tension assembly. When the curtain rod is sufficiently tight in position, the end caps may be moved over the tension assemblies to hide them from view. If desired a tension assembly may be used at each end of the curtain rod.

The present tension assembly and curtain rod combination has definite advantages over prior art structures. By a very simple movement a curtain rod may be affixed in place between two walls. The curtain rod is maintained very securely in place. The tension assembly is relatively simple and inexpensive to manufacture. It may be covered over by the use of an end cap. This provides an inexpensive very strongly mounted system with excellent appearance.

Although the invention has been shown in FIGS. 1–12, as having a tension plate provided with an oblique cam surface and a cam member adjacent the tension plate provided with a complementary oblique cam surface, this structure may be reversed and the wall mounting plate may be provided with an oblique cam surface and the cam member end adjacent the wall mounting plate may be provided with a complementary cam surface. Alternatively, as shown in FIGS. 14–18, both the wall mounting plate and the tension plate may be provided with oblique cam surfaces and the cam member provided at each end with complementary oblique cam surfaces. Further, although the longitudinal flange 30 or 118 as shown is provided as an integral portion of the wall mounting plate, alternatively it may be provided as an integral portion of the tension plate. Further, although the transverse channels have been provided in the wall mounting plate and tension plate and the complementary guide members provided on the cam member, the reverse may be utilized, with the transverse channels provided on the cam member and the complementary guide members provided on the wall mounting plate and the tension plate. In such a structure the oblique cam surface of the cam member would be split and positioned on each side of the transverse channel.

It is to be understood that the invention is not to be limited to the exact details of construction or operation or materials shown and described, as obvious modifications and equivalents will be apparent to one skilled in the art.

Invention is claimed as follows:

1. In combination, a curtain rod and tension assembly adapted to be mounted between two walls, said curtain rod comprising an elongate member having means for mounting a curtain, said tension assembly comprising:

(1) a wall mounting plate adapted to engage a wall in abutting relationship, (2) a cam member having at least one oblique cam surface and a threaded transverse hole, (3) a tension plate having means at one end for engaging the end of said curtain rod, (4) a longitudinal flange provided as an integral part of one member of said wall mounting plate and said tension plate having longitudinal guide means, the other member of said wall mounting plate and said tension plate having complementary guide means slidably engaged with the guide means of said longitudinal flange, said longitudinal flange having a hole provided therein, and (5) a screw extending through the hole in said longitudinal flange and threadedly engaged in the threaded hole provided in said cam member, one member of said cam member and said wall mounting plate having a transverse channel provided therein and the other a guide member slidably engaged in said channel, one member of said cam member and said tension plate having a transverse channel therein and the other having a guide member slidably engaged in said channel, and at least one member of said wall mounting plate and said tension plate having a complementary oblique cam surface engaging the oblique cam surface of said cam member, whereby tightening of said screw causes said cam member to move said tension plate away from said wall mounting plate and causes said curtain rod and said tension assembly to become wedged between said walls.

2. In combination, a curtain rod and tension assembly adapted to be mounted between two walls, said curtain rod comprising an elongate member having means for mounting a curtain, said tension assembly comprising:

(1) a wall mounting plate adapted to engage a wall in abutting relationship, (2) a cam member having a first oblique cam surface and a threaded transverse hole, (3) a tension plate having means at one end for engaging the end of said curtain rod, (4) a longitudinal flange provided as an integral part of said wall mounting plate having longitudinal guide means, said tension plate having complementary guide means slidably engaged with the guide means of said longitudinal flange, said longitudinal flange having a hole provided therein, and (5) a screw extending through the hole in said longitudinal flange and threadedly engaged in the threaded hole provided in said cam member, said wall mounting plate having a transverse channel provided therein and said cam member having a guide member slidably engaged in said channel, said tension plate having a transverse channel therein and said cam member having a guide member at the other end thereof slidably engaged in said channel, and said tension plate having a complementary oblique cam surface engaging the first oblique cam surface of said cam member, whereby tightening of said screw causes said cam member to move said tension plate away from said wall mounting plate and causes said curtain rod and said tension assembly to become wedged between said walls.

3. A curtain rod and tension assembly according to claim 2, wherein lugs are provided on the ends of said tension plate engaging the end of said curtain rod.

4. A curtain rod and tension assembly according to claim 2, having a cap slidably mounted on said curtain rod and adapted to cover said tension assembly.

5. A curtain rod and tension assembly according to claim 2, wherein said cam member is provided with a second oblique cam surface and said wall mounting plate being provided with an oblique cam surface engaging the second cam surface of said cam member, whereby extended travel between said wall mounting plate and said tension member is provided, and wherein the hole in said longitudinal flange is elongated to permit longitudinal travel of said cam member with respect to said wall mounting plate.

6. A curtain rod and tension assembly according to claim 2, wherein said curtain rod is provided with tracks, and a plurality of curtain hooks are provided having enlarged heads slidably retained within said tracks.

7. A curtain rod and tension assembly according to claim 2, wherein a pad is provided at the outer surface of said wall mounting plate to prevent marring of the walls against which said plate is mounted.

8. A curtain rod and tension assembly according to claim 2, wherein said longitudinal guide means comprises a channel at each edge of said longitudinal flange and said complementary guide means of the tension plate comprises tracks slidably engaged in the channel at each of the edges of said longitudinal flange.

* * * * *